US008734585B1

(12) United States Patent
Muncy

(10) Patent No.: US 8,734,585 B1
(45) Date of Patent: May 27, 2014

(54) FAN BLADE CLEANING DEVICE

(76) Inventor: Derrick E. Muncy, McMinnville, TN (US)

( * ) Notice: Subject to any disclaimer, the term of this patent is extended or adjusted under 35 U.S.C. 154(b) by 103 days.

(21) Appl. No.: 12/855,321

(22) Filed: Aug. 12, 2010

(51) Int. Cl.
*B08B 7/00* (2006.01)

(52) U.S. Cl.
USPC ..... 134/6; 134/42; 15/160; 15/210.1; 15/220.3; 15/230.11

(58) Field of Classification Search
USPC ..... 134/6, 42; 15/160, 210.1, 220.3, 230.11
See application file for complete search history.

(56) References Cited

U.S. PATENT DOCUMENTS 4,458,375 A * 7/1984 Killeen ..... 15/236.07
4,823,431 A * 4/1989 Carpenter ..... 15/394
4,827,556 A * 5/1989 Corsetti ..... 15/244.1
4,841,592 A * 6/1989 Restivo ..... 15/210.1
5,116,151 A * 5/1992 Lytton et al. ..... 401/9
D328,373 S * 7/1992 Murray ..... D32/40
5,337,445 A * 8/1994 Harris et al. ..... 15/394
D350,424 S * 9/1994 Elliott ..... D32/40
5,369,836 A * 12/1994 Horne ..... 15/210.1
6,345,409 B1 * 2/2002 LaCroix ..... 15/394
6,782,579 B1 * 8/2004 Grimm ..... 15/246
7,735,181 B1 * 6/2010 Thomas ..... 15/220.3
7,802,340 B2 * 9/2010 Knopow et al. ..... 15/144.1
7,958,591 B1 * 6/2011 Rogers ..... 15/210.1

FOREIGN PATENT DOCUMENTS

CN 200980657 * 11/2007
CN 201953725 * 8/2011

* cited by examiner

*Primary Examiner* — Bibi Carrillo
(74) *Attorney, Agent, or Firm* — Waddey Patterson; Ryan D. Levy; Mark A. Pitchford

(57) ABSTRACT

A cleaning device for blades of a fan including a first arm with distal end and proximal end, a first cleaning element attached to the proximal end and a second arm with a distal end and proximal end, a second cleaning element attached to the proximal end as well as a pivoting joint connected to the distal end of the first arm and the distal end of the second arm the pivoting joint also having a handle connection.

19 Claims, 7 Drawing Sheets

FAN BLADE CLEANING DEVICE

BACKGROUND OF THE INVENTION

1. Technical Field

The present invention relates to the cleaning of fan blades as well as providing a method for cleaning fan blades, generally directed toward ceiling fans. In optional embodiments of the invention, the device may be capable of cleaning both the top and bottom of a ceiling fan in a substantially simultaneous fashion. Furthermore, the optional embodiments may include cleaning elements that may be disposable or the like.

2. Background Art

In the field of temperature regulation, fans are often utilized on the ceilings of homes, offices or other dwellings. The fans typically rotate in such a fashion so as to either push or pull air, depending on the orientation of the blades and the direction of rotation. Often, these fans accumulate dirt, including dust and or debris as well as allergens. Specifically, the dirt may accumulate on the upper and lower portions of the fan blades as they have a tendency to quickly gather dirt.

Attempts to remove the dirt from fan blades differ. As dirt is generally undesirable and can include allergens, individuals generally attempt to remove the dirt from the fan blades. In doing so, various devices and methods have been implemented in this regard. For example, U.S. Pat. No. 4,458,375 teaches a fan blade cleaner apparatus which may provide a handheld, pocket sized apparatus to clean the blades of a multi-blade centrifugal fan, particularly found in air conditioning and ventilation units.

U.S. Pat. No. 4,823,431 teaches a fan blade cleaning device that includes a one piece cleaning cover that can be removed or replaced for cleaning. Alternatively, U.S. Pat. No. 4,827,556 teaches ceiling fan blade cleaning devices which may include a forked member with a tubular handle with a proximal end by which a user holds the device for cleaning.

Other devices include U.S. Pat. No. 4,841,592 for a fan blade cleaning tool which includes a cleaning element removably mounted within a housing, the element having interior surfaces defining a centrally disposed passageway aligned to frictionally engage an outer surface of the fan blade for removing debris there from. U.S. Pat. No. 5,116,151 discloses a ceiling fan cleaning apparatus with an L-shaped flange with the end defining a channel for receiving a ceiling blade fan there within. U.S. Pat. No. 5,337,445 teaches a vacuum fan duster including a vacuum assisted cleaning apparatus for cleaning the surfaces of a ceiling fan which provides a dust receptacle for capturing displaced dust that is not initially picked up by the vacuum. U.S. Pat. No. 6,345,409 discloses a vacuum nozzle for cleaning ceiling fan blades with a lightweight housing with an air chamber having an aperture and a tapered tubular neck which may be installed at the end of a vacuum hose or a wand. U.S. Pat. No. 6,782,579 discloses attachable duster for ceiling fans where the duster is attachable to a ceiling fan for cleaning the fan blades during operation with adjustable arms to position the arms so that while the fan rotates the duster cleans off excess dust.

Unfortunately, fan blade cleaning devices of the prior art are not as effective or simple to use in cleaning fan blades. Some embodiments require the use of a vacuum in a coordinated effort to remove dust or debris from a fan blade while others simply rely on the user applying pressure to one side of the fan blade to remove dirt. The devices generally available are not capable of cleaning both sides of the fan blade in adequate arrangement and generally do not provide for the user to easily push the cleaning device over the fan blade and remove it from the fan blade. In addition, a user might likely desire to have the cleaning device adaptable to various cleaning elements.

What is desired, therefore, is a cleaning device for blades of a fan which includes multiple arms and also a pivoting joint with a combination of such elements providing for the cleaning device to be improved over the prior art and especially comfortable for the user. Indeed, a combination of characteristics, including the capacity to change the blade passage area between the cleaning elements provides for ease of cleaning a fan blade while optionally also providing for the removability and replacement of cleaning elements. Also desired is a process for cleaning fan blades with the device of the invention.

SUMMARY OF THE INVENTION

The present invention optionally provides a cleaning device for blades of a fan which is capable of cleaning both sides of a fan blade simultaneously. Optionally, the cleaning device may provide a user with a multiplicity of ways of cleaning as in optional embodiments the handle may be attached to a shaft to clean fan blades located out of reach.

An optional object of the invention is to provide a fan blade cleaning device which includes a first arm with a cleaning element and a second arm with a cleaning element for cleaning both the top side and bottom side of a fan blade.

Yet another optional object of the invention is to provide a cleaning device for a fan blade with a first arm with a first cleaning element and a second arm with a second cleaning element attached to a pivoting joint with the fan blade being inserted between the first cleaning element and the second cleaning element for cleaning thereof.

Yet another optional object of the invention is to provide a cleaning device for a fan blade which is economical to produce and is relatively simple and reliable to use by the user. Still another optional object of the invention is a cleaning device for a fan blade including a pivoting joint so that sufficient space is available between the two cleaning arms to insert the fan blade whereupon movement by the user causes the cleaning elements to push closer together to provide additional force in cleaning the fan blade and removing dirt.

Yet still another optional object of the invention is to provide a cleaning device for a fan blade where the first cleaning element and the second cleaning element are removably attachable and optionally replaceable.

Still another optional object of the invention is a method of cleaning a fan blade which uses the cleaning device having a first arm and a second arm with individual cleaning elements as well as a pivoting joint for allowing pivoting and a movement of the first cleaning element relative to the second cleaning element or vice versa.

In accordance with the purpose of the invention, as embodied and broadly described herein, the invention includes a first arm with a distal end and a proximal end with a first cleaning element attached to the proximal end and additionally a second arm with a distal end and a proximal end with a second cleaning element attached to the proximal end of the second arm with a pivoting joint connected to both the first arm and second arm as well as a handle. The cleaning device for the fan blade may include one or more of the arms being pivotally attached to the pivoting joint for a restricted amount of rotation. Additionally, the cleaning device may include cleaning elements that may embody a variety of optional designs including rolling cleaning attachment elements. The cleaning device optionally may include disposable cleaning elements and in further embodiments may simply include locations for cleaning elements to attach. Furthermore the cleaning device for fan blades of the present invention may optionally include adapters on the first arm and the second arm for connecting to cleaning elements commercially in production which may include disposable dusters including the Swiffer® duster. The adapter for the cleaning elements on either the first arm or the second arm may comprise two generally elongated prongs for the use with commercially available cleaning and dusting products or alternatively may attach to generally round cleaning elements for the removal of dirt from a fan blade.

In use, a user may place the fan blade between the first cleaning element and the second cleaning element of the cleaning device and may subsequently apply force to the handle which in turn pushes the first cleaning element and the second cleaning element toward one another and in greater contact with the fan blade. The user may then move the cleaning device laterally so that the cleaning elements move across the surfaces of the fan blade and remove dirt. Upon finishing cleaning the user may simply pull the duster off the fan blade or alternatively may apply additional force to the handle in such a manner so as to create a larger space between the first cleaning element and the second cleaning element.

As used herein the term "engage" means to interact with, associate with or communicate with.

Further as used herein the term "dirt" is used to mean dirt, dust, debris, allergens, and the like.

The term "providing" and forms thereof, are used in a broad sense, and are referred to, but are not limited to, making available for use, enabling usage, giving, supplying, obtaining, getting hold of, acquiring, making ready for use, and/or placing into position ready for use.

According to another optional aspect of the invention, the device may include a variety of different cleaning elements for use in cleaning a fan blade. In one optional embodiment there may be included rolling cleaning elements wherein the cleaning elements rotate or at least have the capacity to rotate on the surfaces of the fan blade. Thus in such optional embodiments a larger surface area of the cleaning element may be in contact with the surfaces of the fan blade to promote more effective cleaning. In further optional embodiments the cleaning elements may comprise generally duster type arrangements of a variety of different fabrics synthetics cottons or the like which are known to either attract or hold dirt.

Yet furthermore, in optional embodiments, the device will simultaneously clean the top portion of the fan blade and the bottom portion of the fan blade simultaneously as a user moves the device along the lateral surface of the fan blade and thus remove dirt onto the cleaning elements of the device. As such, a user may clean the fan blade quicker and easier as one is not only cleaning both top and bottom of the fan blade at the same time but furthermore includes a pivoting element so that the distance between the arms can be lessened so that greater pressure may be exerted on the surfaces of the fan blade during cleaning to increase removal of dirt from the fan blade.

Yet another optional aspect of the invention may include the use of generally compressible attachments for receiving cleaning elements having a generally round cross section for the use of round cleaning elements.

An additional optional aspect of the invention may include a portion of at least one of the first arm and the second arm near to the proximate end that is flexible. Other optional aspects of the invention may include a variety of materials comprising the arm to include both metals and plastics.

Yet a further optional aspect of the invention may include an extension which may engage the handle so that the user may use the cleaning device to clean blades of fans that are not within reach with the device alone.

Aside from the structural and procedural arrangements set forth above, the invention could include a number of other arrangements, such as those explained hereinafter. It is to be understood, that both the foregoing description and the following description are exemplary.

BRIEF DESCRIPTION OF THE DRAWINGS

The accompanying drawings are incorporated and constitute a part of the specification. The drawings illustrate optional embodiments of the invention and together with the description serve to explain some principles of the invention.

Reference will now be made in detail to optional embodiments of the invention, examples of which are illustrated in accompanying drawings. Whenever possible, the same reference numbers are used in the drawings and in the description referring to the same or like part.

DETAILED DESCRIPTION OF THE PREFERRED EMBODIMENTS

Figure 1A:
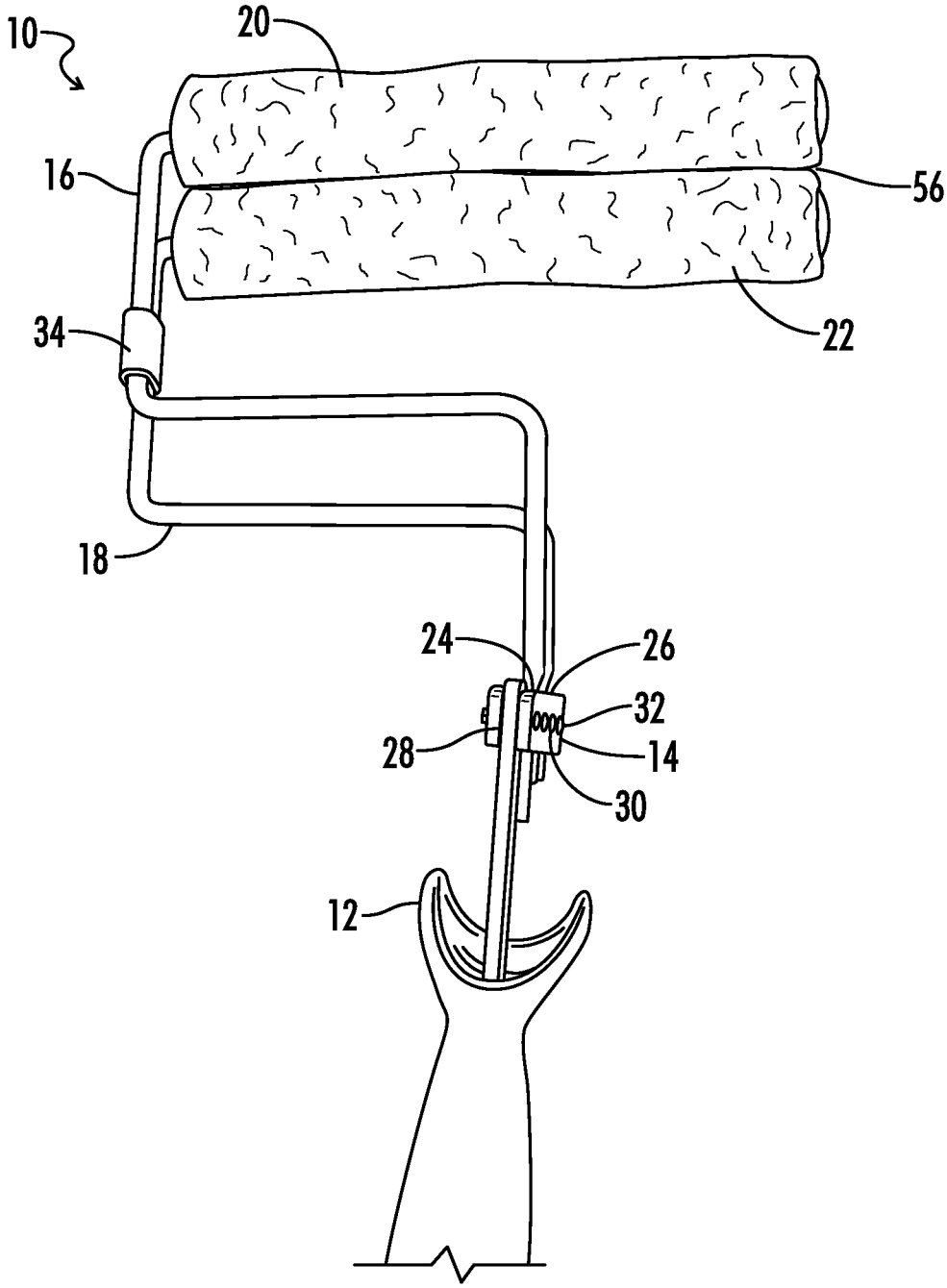
FIGS. 1A-D are views of an optional embodiment of the cleaning device for a fan blade of the present invention.
Figure 1B:
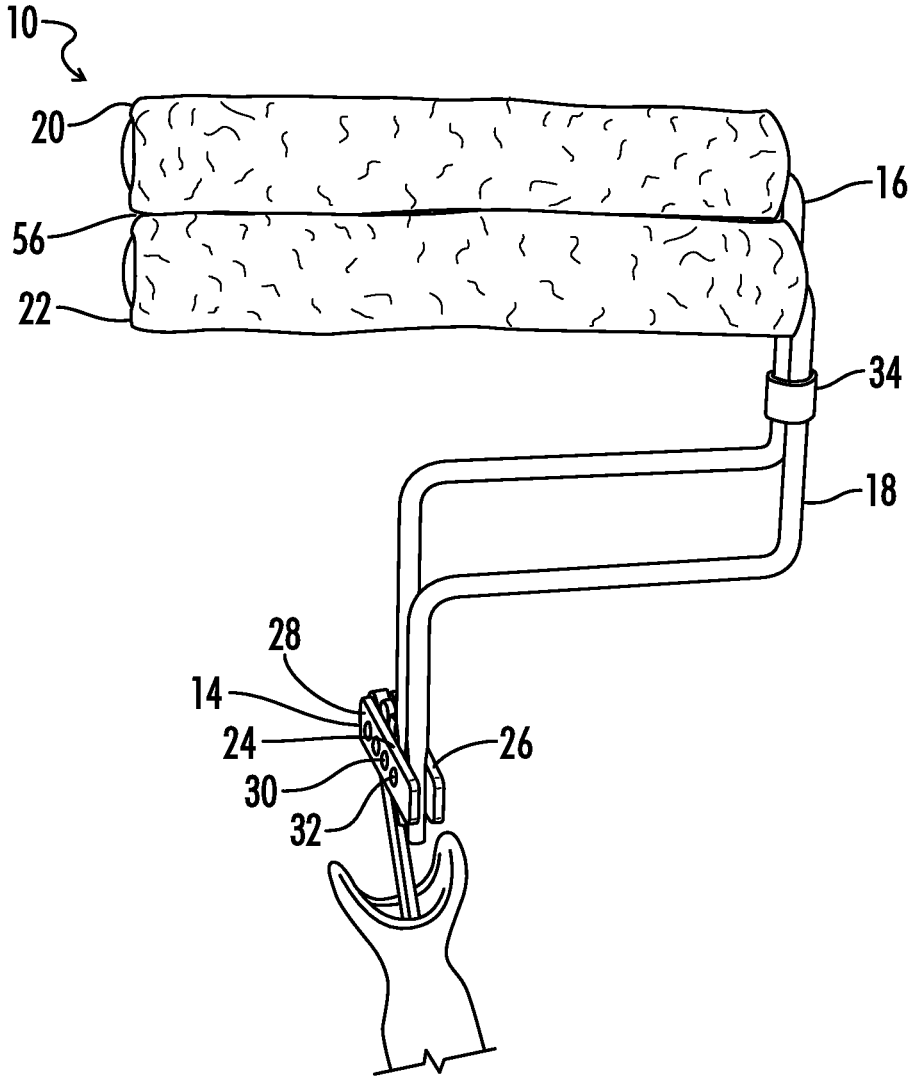
Figure 1C:
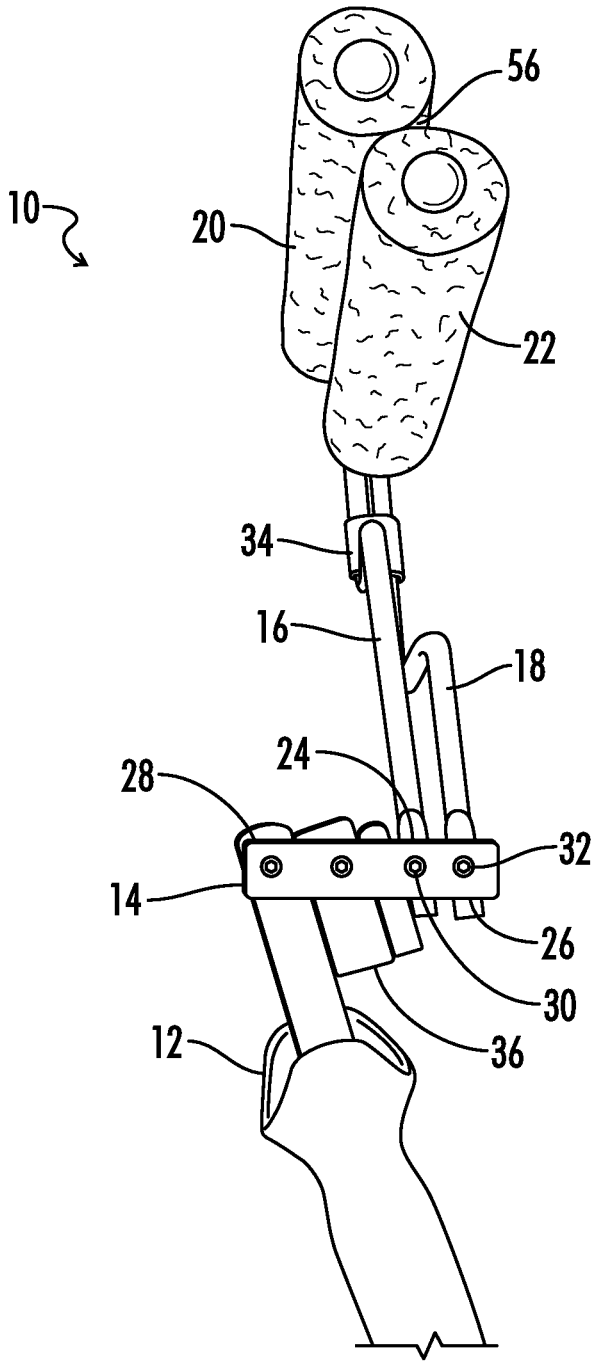
Figure 1D:
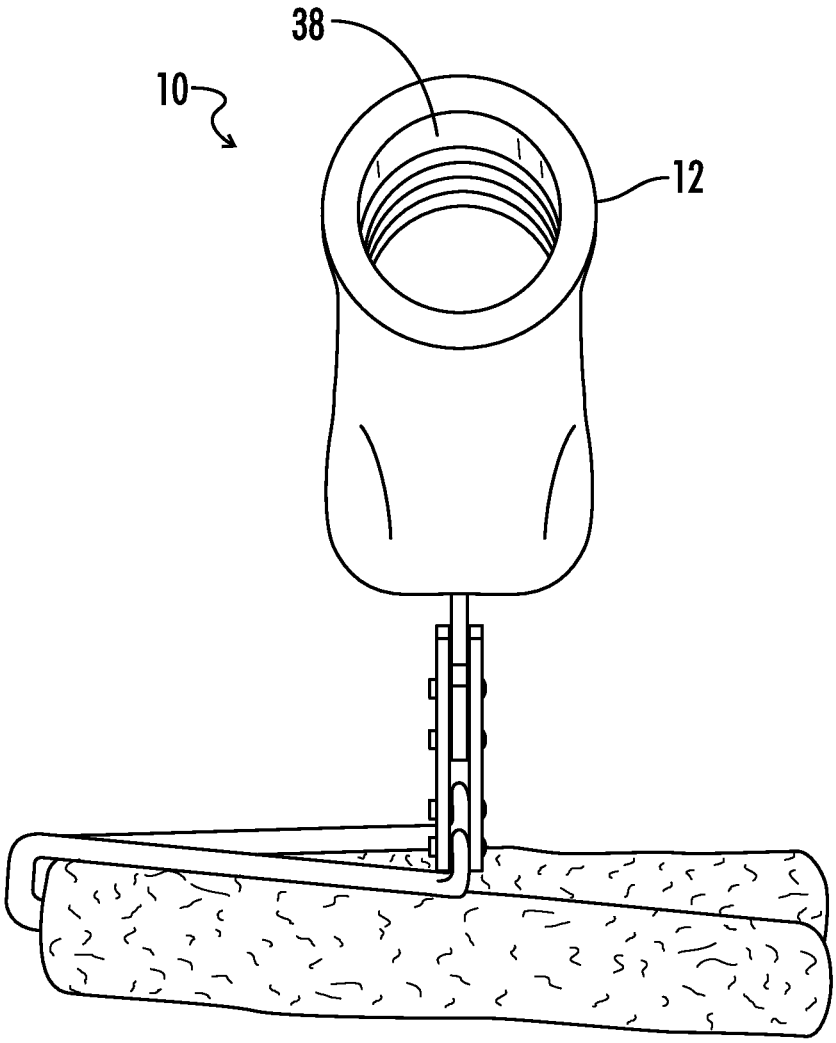

As illustrated in the accompanying drawings there are multiple optional embodiments of the cleaning device for fan blades indicated by numeral 10. Generally, cleaning device 10 includes arms 16 and 18, handle 12 and pivoting joint 14.

Handle 12 may include engagement hole 38 which may be used to connect cleaning device 10 to a pole, shaft or the like for use in cleaning fan blades that are beyond the reach of the user with the device alone. Optional embodiments of handle 12 may further include threading, grooves, posts or the like with engagement opening 38 or without so as to provide for opportunity to engage the shaft, pole or the like. Furthermore, handle 12 additionally connects to pivoting joint 14.

Pivoting joint 14 is understood to connect to both handle 12 via handle connection 28 and also connect to upper arm 16 and lower arm 18 at first distal end 24 and second distal end 26 of the arms. As used herein the term "pivoting joint" is understood to allow at least one of handle 12, upper arm 16, and lower arm 18 the capacity to pivot relative to at least one of the other items. Otherwise stated at least one of upper arm 16, lower arm 18, and handle 12 can exhibit a limited degree of rotation with the attachment to pivoting joint 14 being the center of rotation. In further optional embodiments, handle 12, upper arm 16, and lower arm 18 are all pivotally attached to the pivoting joint and thus may each display a limited rotation. In such optional embodiments, generally the rotation of each of upper arm 16 lower arm 18 and handle 12 are in generally the same plane as pivoting joint 14 restricts substantial movement in other directions.

Optionally pivoting joint 14 may include two individual pieces of material sandwiching first distal end 24 of upper arm 16, second distal end 26 of lower arm 18, and handle connection 28 connected to handle 12 all between the two pieces of metal plastic or the like. In further optional embodiments, pivoting joint 14 may include a variety of different materials and designs so long as at least one of upper arm 16, lower arm 18, and handle 12 may be allowed to pivot and in further optional embodiments all three of the items may exhibit at least some limited rotational movement.

The capacity of pivoting joint 14 to allow movement of the various items allows for each of the elements to move with respect to one another and thus move closer or further apart in manipulating the invention. While specific uses may be described later the capacity of both arms 16 and 18 to be pivotally attached to pivoting joint 14 allows for various elements to be purposely moved closer or farther apart.

Arms 16 and 18 generally include proximal ends which may be indicated by numeral 40 and further may include a first distal end 24 and second distal end 26 corresponding to each of arms 16 and 18. In optional embodiments of cleaning device 10, upper arm 16 and lower arm 18 may include a generally U-shaped configuration so that cleaning device 10 may have a more ergonomic design and provide for greater ease in cleaning fan blades. In further optional embodiments of cleaning device 10 arms 16 and 18 may include a generally L-shaped or angle shaped design for cleaning.

Upper arm 16 may be described as the arm with the first cleaning element 20 which will clean generally the upper surface of a fan blade. As used herein the upper surface of a fan blade is understood to be the surface of a fan blade closer to the ceiling on which dirt may settle or attach. Upper arm 16 in optional embodiments is designed so that it may be attached at distal end 24 to first arm attachment point 30 on pivoting joint 14 closer to handle attachment 28 of pivoting joint 14. In further optional embodiments, first arm attachment point 30 and second arm attachment point 32 may be reversed with first distal end 24 of upper arm 16 being attached further away from handle connection 28 of cleaning device 10 though the reversed configuration as just described would require opposite manipulation of cleaning device 10 for use. Generally speaking, at least one of the attachments of arms 16 and 18 to pivoting joint 14 may be closer to handle attachment 28 and not spaced evenly from handle attachment 28 of cleaning device 10.

Lower arm 18 of cleaning device 10 includes second cleaning element 22 generally positioned for cleaning the bottom surface of a fan blade, the surface of the fan blade facing the floor of a building. In optional embodiments of the invention, lower arm 18 with second distal end 26 attaches at second arm attachment 32 further from handle connection 28 then first arm attachment 30 corresponding to upper arm 16. Otherwise stated, in optional embodiments, lower arm 18 is pivotally connected to pivoting joint 14 further from the connection of handle 12 then upper arm 16. Lower arm 18 may additionally include a variety of shapes, contour sizes, as described and referenced to upper arm 16.

There may generally be a somewhat shorter length to lower arm 18 to position second cleaning element 22 below first cleaning element 20. The positioning of first cleaning element 20 of upper arm 16 and second cleaning element 22 of lower arm 18 provides for blade passage area 56 between the two cleaning elements. In optional embodiments, first cleaning element 20 removes dirt from the upper surface of a fan blade and second cleaning element 22 removes dirt from the surface of the fan blade passing within blade passage area 56.

Figure 3:
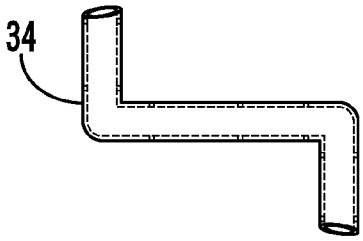
FIG. 3 is an illustration of an arm guide of the present invention.

In orienting upper arm 16 and lower arm 18 together, optional embodiments may include arm guide 34 for maintenance of this arrangement. In further optional embodiments, arm guide 34 may cover a substantial portion of upper arm 16 and lower arm 18 as illustrated in optional embodiments of FIG. 3.

A cleaning element of cleaning device 10 may include a variety of structures and optional embodiments and further may include some of the configurations found within the accompanying figures. One such design is a rolling type cleaning element wherein each cleaning element generally is a roller with an outer surface capable of cleaning dirt from a fan blade. In such optional embodiments, the cleaning elements may roll on the surface on the blade of the fans or alternatively may be generally fixed but yet still remove dirt from the surface of the fan. In such optional embodiments, with round cleaning elements, a user advantageously has an increased surface area for use with removing dirt from the fan.

Figure 2:
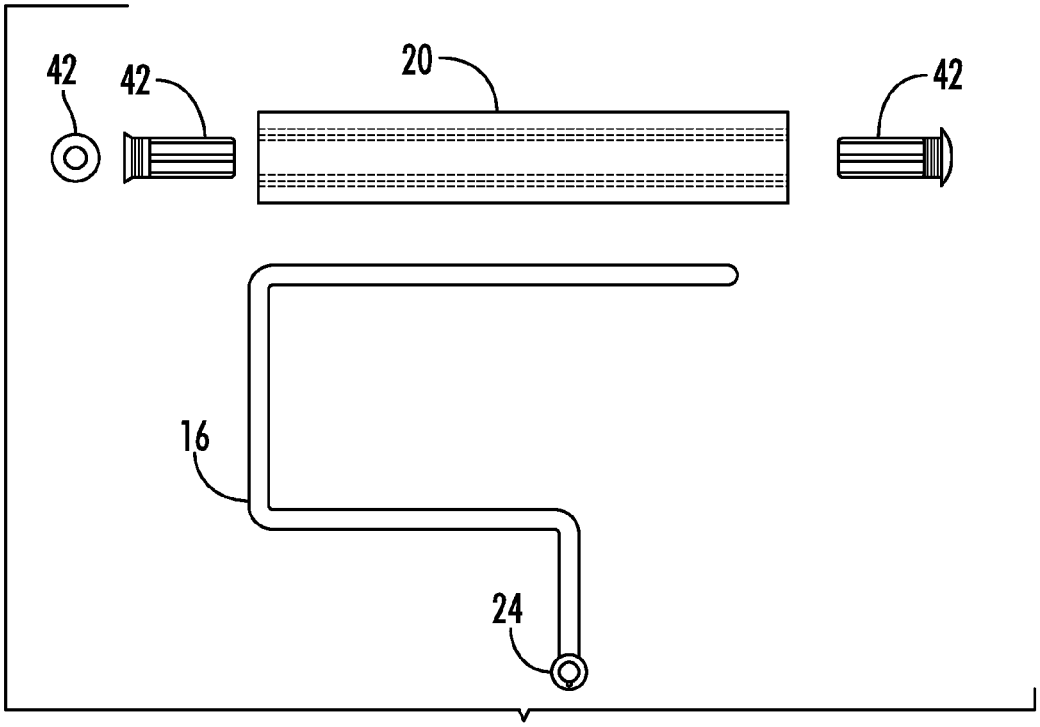
FIG. 2 is an exploded view of an arm with a cleaning element of the present invention.

As is further illustrated in FIG. 2, the roller cleaning elements may be removable from either the upper or lower arm and additionally may include attachment elements 42 for securing a roller type cleaning element to one of the arms. While FIG. 2 is generally described with references to upper arm 16, a similar arrangement may be utilized for either the upper arm or lower arm with the major difference being the length and size of the arm.

In further optional embodiments, roller type cleaning elements may be permanently attached or alternatively removeable from cleaning device 10. In optional embodiments with roller cleaning elements removeable, the user is allowed and capable to replace roller elements when either saturated with dirt or no longer removing sufficient quantities of dirt from the fan blade.

In further optional embodiments, upper arm and lower arm, 16 and 18, may be utilized with commercially available dusting devices such as those provided by Swiffer®. In such optional embodiments, the arms may include integrated cleaning adapters 46 for attachment of the Swiffer dusting element, or the like thereto. In such optional embodiments, generally two elongated prongs may provide the necessary structure to adapt to these commercially available products.

Figure 4:
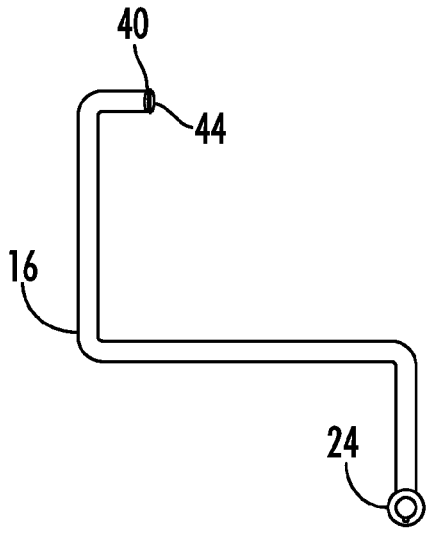
FIG. 4 is an illustration of an optional embodiment of an arm with an attachment for an adapter.
Figure 5:
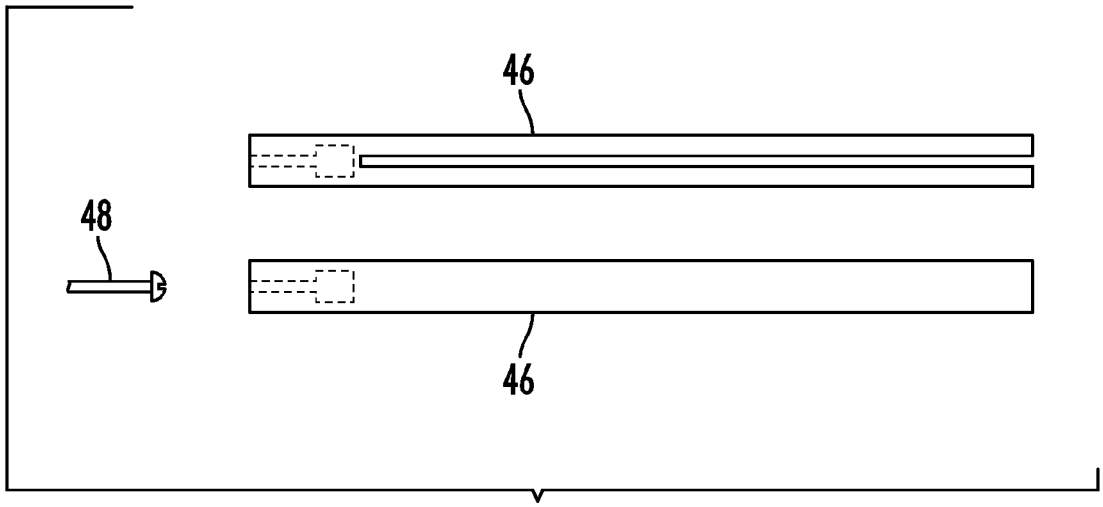
FIG. 5 is an illustration of an optional embodiment of an adapter for a cleaning element for the present invention.
Figure 6:
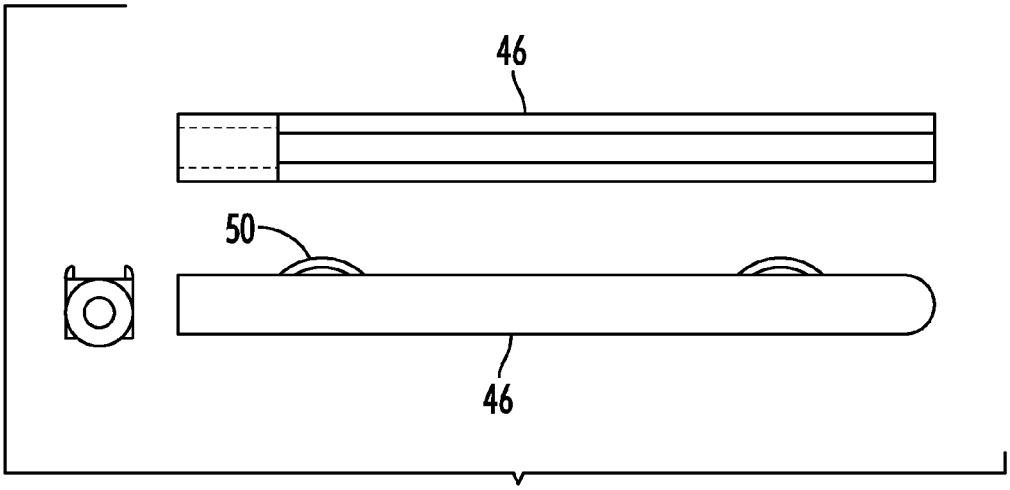
FIG. 6 is an optional embodiment of an adapter for a cleaning element of the present invention.

In further optional embodiments as illustrated in FIGS. 4-6 either of the arms may include adapter attachments for connecting of an adapter thereto for various types of cleaning adapters 46. In optional embodiments of the invention, cleaning adapters 46 are generally understood to be structures for the attachments of removable cleaning elements thereto. Generally speaking cleaning adapters 46 include the structure for holding the necessary material for removing dirt from a fan blade. In further optional embodiments, connection 44 may be used to attach to various adapters thereto. This can include a threaded end as well as a pressure fit arrangement or other types of structural designs to engage an adapter. As illustrated in FIG. 5, commercially available dusting devices may be attached to the device including those of a Swiffer® similarity or the like. In yet further optional embodiments, the cleaning adapters 46 may provide a compression fit for the attachment of cleaning elements thereto. This may include the use of round type cleaning elements with cleaning adapter 46 having compressible element 50 providing enough compression to maintain and hold the cleaning element in place. Hardware 56 may also be used to attach adapters 46 to the arms, which may include a variety of screws, fittings or the like.

Generally, as used within the present disclosure, the terms "first" and "second" with regard to the cleaning elements may be utilized with either of the elements and any discussion of one arm with respect to cleaning elements should be understood as being capable of being applied to the other arm of the cleaning device.

Figure 7A:
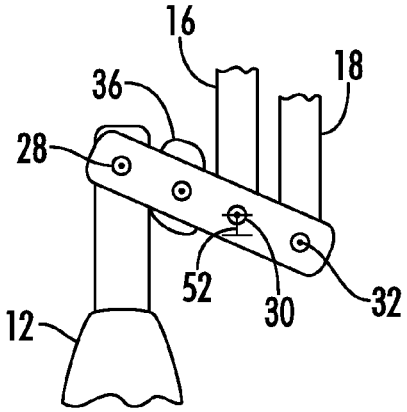
FIGS. 7A-B are illustrations of the pivoting joint of the present invention.
Figure 7B:
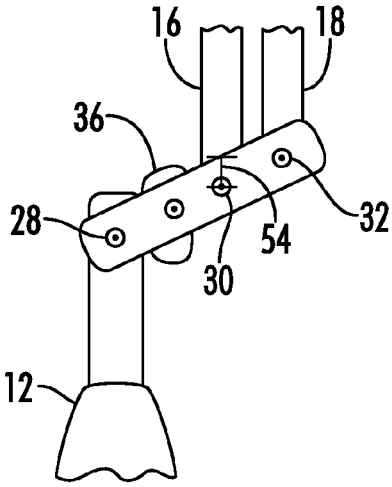

Referring now to FIGS. 7A and 7B there are two illustrations of pivoting joint 14 in various arrangements. Advantageously, the use of pivoting joint 14 combined with the attachments of the arms as well as the handles provides for a user to easily insert the fan blade within fan passage area 56 and subsequently apply sufficient pressure to remove dirt from the fan blade. Pivoting joint 14 allows for the fan blade passage area 56 to increase in size when measured from the bottom of first cleaning element 20 of upper arm 16 to the top of second cleaning element 22 of lower arm 18. This may be accomplished by the slight rotation of the arms and handles relative to their attachment to pivoting joint 14. As illustrated in FIG. 7A the attachment of upper arm 16 at first arm attachment 30 has a displaced distance 52 measured to second arm attachment 32 of lower arm 18. In this illustration of FIG. 7A one may understand the device as being held loosely at handle 12. Held in this orientation one may understand fan blade passage area 56 to be at a near maximum space as displacement distance 52 is created within fan blade passage space in addition to any distance that results between the three elements when first arm attachment 30 and second arm attachment 32 are level. Thus in such an orientation a user may experience greater ease in inserting a fan blade between elements.

Conversely in FIG. 7B second arm attachment 32 is higher than first arm attachment 30 resulting in displacement space 54. As lower arm 18 positions second cleaning element 22 below first cleaning element 20 of upper arm 16 the distance between the cleaning elements is decreased by a displacement distance 54.

In optional embodiments of cleaning device 10, the configuration as illustrated in 7B may be accomplished when a user inserts a fan blade within fan blade passage area 56 when oriented as in FIG. 7A and then subsequently pulls downward on handle 12 resulting in the pivoting of upper arm 16, lower arm 18 and handle 12 at pivoting joint 14 to thus decrease the space between the cleaning elements. Otherwise stated, upper arm 16 and lower arm 18 are moved toward one another generally about the sum of displacement distance 52 and displacement distance 54 from where cleaning device is held at rest to where a fan blade is inserted and a user is pulling downward on handle 12.

In yet further optional embodiments not illustrated, the location of upper arm 16 and lower arm 18 with regard to attachment pivoting joint 14 may be reversed with upper arm 16 being attached further from the attachment to handle 12. In such different embodiments of cleaning device 10, the displacement distance would be reversed where the least amount of fan blade passage area 56 would be where the handle 12 is pushed upward. Similarly the greatest space of such an optional embodiment would be where a user pulls downward on handle 12.

In optional embodiments, rotation restrictor 36 may be utilized with the invention. Such inclusion may depend on the size of the joint and the spacing of the arms for containing the cleaning elements. Rotation restrictor 36 may preclude the rotation of the arms as it may function as a spacer between the connection of the joint to the handle and the connection to the arms.

Generally speaking the manipulation of the cleaning elements together and apart is accomplished through the use of a pivoting joint as the pivoting allows the distance between the proximal areas of upper arm 16 and lower arm 18 to change depending on the orientation of where upper arm 16 and lower arm 18 are attached to the pivoting joint. As illustrated in FIG. 7A lower arm 18 attachment to the pivoting joint is relatively lower than upper arm 16 attachment to the pivoting joint. Thus by changing the relative positioning of lower arm and upper arm attachment to the pivoting joint one is able to alter the distance between the arms of the rotation of the cleaning elements. As the attachment of lower arm 18 is moved upward relative to the attachment of upper arm 16, space is diminished between elements of the arms and as the attachment of lower arm 18 rises above the attachment of upper arm 16 an even greater displacement occurs resulting in the cleaning elements of the arms coming closer together. Thus by applying force to the handle, optionally pulling downward, with the arrangement of the arms as illustrated in FIGS. 7A and 7B less space is available between the cleaning elements resulting in greater force on the fan blade for cleaning.

Yet furthermore, if a user needs to easily remove cleaning device 10 from a fan blade without finishing the cleaning of a lateral surface a user is to simply push upward for the orientation of the arms attachments as in 7A and 7B to increase the distance between the cleaning elements and thus allow for easy removal of the blade from within the blade passage area.

The blade cleaning device may vary in accordance with the additional aspects of the invention and may include a variety of different attachments to components including screws bolts hinges washers and the like so that a pivoting joint may be realized with the necessary elements attached. Generally optional embodiments of the cleaning device of the present invention may include the use of metals plastics polymers or the like and furthermore include flexible or rigid materials for their use. In optional embodiments, the arms of the present invention may be constructed out of various materials for use including both plastics and metals.

Furthermore, sizes of various structural parts and materials used to make the above-mentioned components are illustrated and exemplary only, and persons of ordinary skill in the art would recognize that these sizes and materials can be changed as necessary to produce different results or different desired characteristics.

It will become apparent to those skilled in the art that there is modification and variations to be made to the structure and methodology of the present invention. Thus, it should be understood that the invention is not limited to the examples discussed in this specification. Rather, the present invention is intended to cover modifications and variations.

What is claimed is:

1. A method of cleaning a fan blade comprising the steps of:

a. providing a cleaning device with
   - a first arm with a distal end and a proximal end, a first cleaning element attached to the proximal end;
   - a second arm with a distal end and a proximal end, a second cleaning element attached to the proximal end;
   - a pivoting joint connected to the distal end of the first arm and the distal end of the second arm, the pivoting joint also having a handle connection; and
   - a handle connected to the handle connection of the pivoting joint;

b. placing the fan blade between the first cleaning element and the second cleaning element;

c. pulling the first cleaning element downward against a top of the fan blade and exert a force on the pivoting joint, wherein the force exerted on the pivoting joint pushes the first cleaning element and the second cleaning element toward one another and in greater contact with the fan blade, and the second cleaning element upward against a bottom of the fan blade; and d. moving the cleaning device along a length of the fan blade.

2. The method of claim 1, wherein moving the cleaning device along the length of the fan blade comprises rolling the first cleaning element and the second cleaning element along the length of the fan blade.

3. The method of claim 1, wherein the cleaning device further comprises an arm guide engaging both the first arm and the second arm.

4. The method of claim 1, wherein at least one of the first cleaning element and the second cleaning element comprises a rolling cleaning element.

5. The method of claim 1, wherein the cleaning device further comprises a cleaning element attachment on at least one of the proximal ends of the first arm and the second arm.

6. The method of claim 1 wherein at least a portion of at least one of the first arm and the second arm near to the proximate end is flexible.

7. The method of claim 1 wherein at least one arm is comprised of metal and plastic.

8. The method of claim 1 further comprising an extension connection.

9. The method of claim 5, wherein at least one of the first cleaning element and the second cleaning element is removably attached to the cleaning element attachment.

10. The method of claim 5 wherein the cleaning element attachment comprises two generally parallel prongs for receiving the cleaning element.

11. The method of claim 5 wherein the cleaning element attachment comprises a generally compressible attachment for receiving cleaning element attachments having a round cross-section.

12. The method of claim 8 wherein the extension connection comprises an engagement hole operable to receive a pole.

13. The method of claim 8 wherein the extension connection comprises an engagement hold having threads operable to receive a pole.

14. A method of cleaning a fan blade comprising the steps of:

a. providing a cleaning device with a first arm with a distal end and a proximal end, a first cleaning element attached to the proximal end;

a second arm with a distal end and a proximal end, a second cleaning element attached to the proximal end;

a pivoting joint connected to the distal end of the first arm and the distal end of the second arm, the pivoting joint also having a handle connection; and a handle connected to the handle connection of the pivoting joint;

b. placing the fan blade between the first cleaning element and the second cleaning element;

c. applying an upward force to the handle to push the second element upward against a bottom of the fan blade and exert a force on the pivoting joint, wherein the force exerted on the pivoting joint pulls the first cleaning element and the second cleaning element toward one another and in greater contact with the fan blade, and the first cleaning element downward against a top of the fan blade; and d. moving the cleaning device along a length of the fan blade.

15. The method of claim 14, wherein the cleaning device further comprises an arm guide engaging both the first arm and the second arm.

16. The method of claim 14 wherein the cleaning device further comprises a cleaning element attachment on at least one of the proximal ends of the first arm and the second arm, and the cleaning element attachment comprises two generally parallel prongs for receiving the cleaning element.

17. The method of claim 14 further comprising an extension connection.

18. The method of claim 17 wherein the extension connection comprises an engagement hole operable to receive a pole.

19. The method of claim 17 wherein the extension connection comprises an engagement hole having threads operable to receive a pole.

* * * * *